US006578673B2

(12) United States Patent
Barker et al.

(10) Patent No.: US 6,578,673 B2
(45) **Date of Patent: *Jun. 17, 2003**

(54) CONCRETE ELEVATOR RAIL AND GUIDANCE SYSTEM

(75) Inventors: Frederick H. Barker, Bristol, CT (US); Richard E. Peruggi, Glastonbury, CT (US); Gilbert W. Wierschke, West Simsbury, CT (US)

(73) Assignee: Otis Elevator Company, Farmington, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/406,441

(22) Filed: Sep. 27, 1999

(65) Prior Publication Data

US 2002/0074192 A1 Jun. 20, 2002

(51) Int. Cl.[7] ..... B66B 9/04; B66B 7/04

(52) U.S. Cl. ..... 187/273; 187/400; 187/408

(58) Field of Search ..... 187/406, 408, 187/409, 273, 274, 275, 373, 400; 417/4; 60/409, 431; 91/52, 433; 104/173.1, 173.2, 183

(56) References Cited

U.S. PATENT DOCUMENTS

| | | | | | |
|---|---|---|---|---|---|
| 1,936,780 | A | | 11/1933 | Arnold et al. | 187/375 |
| 3,018,850 | A | * | 1/1962 | Fehlmann | 187/273 |
| 3,359,687 | A | * | 12/1967 | Wallace | 49/477.1 |
| 3,826,329 | A | * | 7/1974 | Crimmins et al. | 180/125 |
| 3,826,330 | A | * | 7/1974 | Midolo et al. | 180/116 |
| 3,949,953 | A | * | 4/1976 | Hopkins | 187/273 |
| 4,443,981 | A | * | 4/1984 | Weiss | 52/155 |
| 4,707,955 | A | * | 11/1987 | Clapson | 52/98 |
| 4,993,327 | A | * | 2/1991 | Labarre et al. | 104/290 |
| 4,997,060 | A | * | 3/1991 | Sassak | 182/48 |
| 5,085,293 | A | * | 2/1992 | Aime | 187/400 |
| 5,321,217 | A | * | 6/1994 | Traktovenko et al. | 187/409 |
| 5,544,720 | A | * | 8/1996 | Spiess | 187/319 |
| 5,564,963 | A | * | 10/1996 | Chan | 446/179 |
| 5,583,326 | A | * | 12/1996 | Sors | 187/277 |
| 5,725,045 | A | * | 3/1998 | Fukihara et al. | 164/404 |
| 5,909,710 | A | * | 6/1999 | Cummins | 104/23.2 |
| 5,950,770 | A | * | 9/1999 | Koeppe, Jr. et al. | 187/406 |

FOREIGN PATENT DOCUMENTS

| | | | | |
|---|---|---|---|---|
| AT | 389688 B | | 1/1990 | |
| DE | 2054936 | * | 5/1971 | 187/408 |
| DE | 004300851 | * | 7/1994 | 187/272 |
| EP | 442230 | * | 8/1991 | 187/408 |
| FR | 1261666 | * | 4/1961 | 187/408 |
| FR | 1570002 | * | 6/1969 | 187/408 |
| JP | 405147858 | * | 6/1993 | 187/408 |
| JP | 406001567 | * | 1/1994 | 187/273 |
| JP | 10139314 | * | 5/1998 | |
| JP | 410338440 | * | 12/1998 | |
| SU | 001089027 | * | 4/1984 | 187/400 |

* cited by examiner

*Primary Examiner*—Eileen D. Lillis
*Assistant Examiner*—Paul T. Chin

(57) ABSTRACT

An integrally poured concrete rail guidance system enables the elimination of traditional metal rails by pouring the concrete rail at the same time as the hoistway is poured. Time and expense is avoided in the construction and the concrete rails are durable. A guidance system is also disclosed

6 Claims, 7 Drawing Sheets

FIG.2
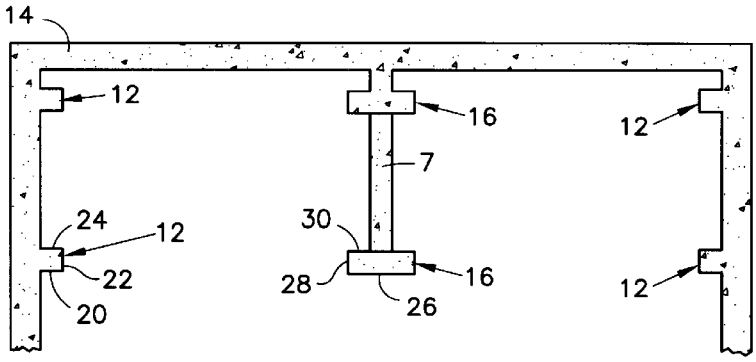
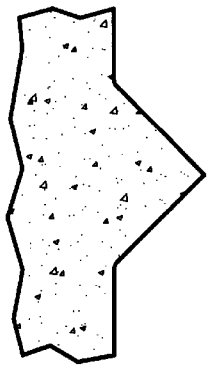
FIG.3
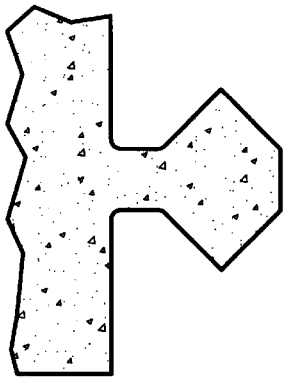
FIG.4
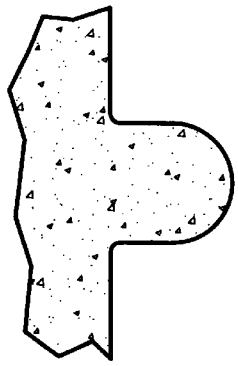
FIG.5

CONCRETE ELEVATOR RAIL AND GUIDANCE SYSTEM

TECHNICAL FIELD

The present invention relates to a rail and guidance system for an elevator car, and more particularly to a concrete rail and a guidance system suitable therefor.

BACKGROUND OF THE INVENTION

Elevator cars are typically guided between a pair of ferrous rails, such as steel, that are mounted vertically within a hoistway of a building. Rollers mounted to the car typically contact the rails and provide the car with a proper position within the hoistway. The rails are also used as fail-safe braking surfaces for emergency stops. In normal operation, the vertical motion of the elevator and all of the arresting of that motion is caused by the hoist ropes, which are moved upwardly and downwardly, and directed by means of a sheave. The ropes are also connected to a counterweight to provide mechanical advantage for moving and stopping the elevator car. The motion of the sheave is controlled by the elevator drive motor and the machine brake which are mechanically coupled to the sheave. Machine brakes typically are spring actuated into the braking position against a drum or a disk attached to the sheave, and use electromagnets to release the brakes from the braking position when the elevator is to move. This provides emergency braking insofar as electrical power or electronic signaling or an elevator safety circuit is concerned.

The steel rails of a typical elevator system are mounted to the hoistway by a series of horizontal supports. Many hoistways are typically comprised of concrete material and are either slip formed or poured in sections and assembled into a stack. The horizontal supports are subsequently attached to the hoistway by known methods and the rails are attached thereto using fasteners that allow the rails to be adjusted horizontally for malalignment. The rails must be manufactured and positioned within the hoistway to strict tolerances to maintain ride quality and uniform safety braking. It is especially difficult to maintain the necessary tolerances and placement of the rails as the building and hoistway tend to move and shift independent of the rails, such as during building compression, sway, thermal expansion or earthquakes. This movement makes it difficult to mount an elevator machine on the rails, which would allow a machine to be placed in an elevator hoistway. Another problem caused by rails being independent of the building is that divider beams must be added between elevators in a multiple hoistway or intervals that are typically 2.5 m which is less than the normal floor-to-floor distance in an office building. This is to provide support for the loads imposed by elevator safety devices.

Another problem with the use of steel rails is their impact on the environment during steel production and transportation and the difficulty in milling the rails to a standard shape within the prescribed tolerances. For each elevator, four (4) runs of steel rails must be provided to cover both sides of the car and counterweight. The weight of each rail ranges from 12 kg/m to 34 kg/m and rails are provided in 5 m sections. Another problem is worker safety because the rail sections must be hoisted, installed and aligned up all elevator hoistways.

The above mentioned rollers are a cause of unwanted noise in higher speed elevators as the rollers are constantly in contact with the rails and rotate at high speed and the friction from roller systems causes energy losses in the elevator system. A prior art elevator system avoids this noise by utilizing electromagnetic guides mounted to the elevator to position the car side to side and front to back within the hoistway. The electromagnetic guides provide a varying amount of electromagnetic force against the ferrous rails to position the car near the center of the hoistway while it is traveling either up or down. Electromagnetic guides require a significant amount of electrical power; in one example 1–2 kW is required to generate the forces necessary to maintain the car in the center of the hoistway.

One problem with prior art rails is that elevator safeties can damage the ferrous rails requiring expensive and time consuming repairs, which includes re-alignment of the rails and sometimes damage to the building after emergency stops and tests.

It is becoming typical in composite building construction to include a generally open rectangular concrete elevator core for buildings. This is due, in part, to the development of high compressive strength concrete. A common method of constructing these cores is generally that of "slip-form" construction where 3 to all 4 walls of a hoistway are poured in a progressive fashion top to bottom, either by pumping the concrete to the top of the building or by lifting hoppers to the top and dumping concrete in the form. The form may be jacked from a pocket in a cured section of the core below. In lower rise buildings pre-cast sections of concrete hoistways may be hoisted, aligned and staged in place.

In all of the prior art constructions the rails are metallic and therefore the elevator systems suffer from the drawbacks noted above. Alternatives to such rails therefore are desirable to the elevator art.

DISCLOSURE OF THE INVENTION

The present invention is a non ferrous guide rail and elevator guide system. In accordance with the present invention, guide rails are provided integrally with the structure of the hoistway and preferably comprise concrete material. The rails are formed as a part of the manufacture of the hoistway either during the slip form process or as part of the precast process. An embodiment of the elevator guide system of the present invention includes a plurality of air cushions positioned on the elevator car proximate the concrete rails. During vertical travel of the elevator car the air cushions are controlled to project a stream of air toward each surface of at least one and preferably all of the rails, and at least the car rails, and to produce a biasing force between each rail and the car. The air is provided by a fan or other source. The streams of air against the various surfaces position the car within the center of each shaft the hoistway providing a smooth and quiet ascent and descent. In one embodiment of the present invention each of the air cushions comprise a plurality of orifices having a seal positioned between the car and the rail to contain or restrict the flow of air therebetween. Another embodiment of the invention includes a control system which comprises a variable orifice controlled by a controller to vary the amount of air being emitted from each individual air cushion. In another embodiment, a controller controls the output of a fan or other air source to vary the amount of air emitted from each air cushion. In another embodiment a self-regulating valve assembly regulates the air flow to each air cushion to keep the car centered about the rail. The biasing force produced by each air cushion is proportional to the air pressure maintained within the air cushion. In another embodiment, conventional rollers or pneumatic tires are included to guide the car or counterweight in lieu of one of these air cushion systems, especially for the counterweight where "ride quality" is much less important.

In another embodiment of the invention, an inclined elevator or people mover is illuminated schematically. The system in the illustration is similar to a conventional inclined elevator in broad review but employs concrete guide rails that are integrally formed as in the prior discussed embodiments of the invention. The inclined elevator system of the invention employs air cushions for higher speed applications and rollers/tires for lower speed applications.

BRIEF DESCRIPTION OF THE DRAWINGS

FIG. 2 is a cross section view of the system of FIG. 1 taken along section line 2—2 in FIG. 1;

FIG. 3 is an alternate poured rail shape;

FIG. 4 is another alternate poured rail shape;

FIG. 5 is another alternate poured rail shape;

BEST MODE FOR CARRYING OUT THE INVENTION

Figure 1A:
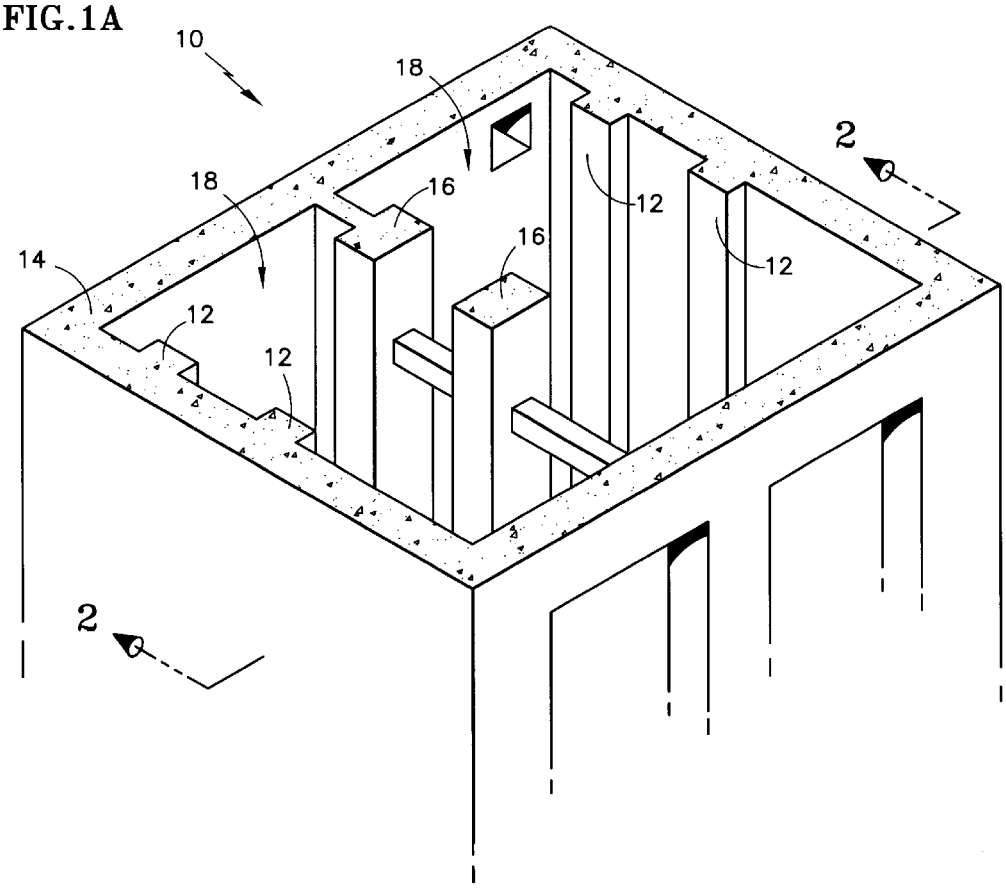
FIG. 1A is a perspective view of the top of a hoistway for an elevator system employing the present invention.

Referring to FIG. 1, a concrete hoistway 10 in accordance with the present invention includes guide features or rails 12 formed as an integral part of the concrete hoistway or hoistway sections when they are poured. These features or rails 12 which for example may extend perpendicularly to the concrete wall 14 or may be in other orientations or configurations are a complete substitute for the prior art metal rails and provide advantages as noted hereinabove. The columns 16 between elevator shafts 18 within a multiple hoistway, and the extension and shape of the other rails, may also be used for building structural advantage, thus minimizing the amount of additional material needed for elevator rails beyond that needed for the building itself.

The invention employs the prior art concept of slip-form construction and includes in the form the rail features to cast the rails in concrete. This method provides a means of easily and quickly creating a hoistway and rail system with extremely tight tolerances. The use of a single "mold" in formwork systems ensures that the rail will always be poured the same size, same distance from the other rails, and same distance from the corewall of which it is a part. The basic concept of slip-form construction is well known to the art and need not be discussed here but to say that the slip-form technique has been adapted to also create rails as well as walls simultaneously as an integrated system.

The nature of slip-form construction keeps the distance between concrete guides relatively equal at every floor. The form may be adjusted so that the cross section of the rails can be sized progressively to allow for the time-dependent effect of hoistway compression and/or gradually lower compressive strength concretes may be used as the hoistway is poured considering the rails "could" otherwise become slightly larger toward the bottom, given the weight of the hoistway and building. However, this invention allows for such variations, top vs. bottom, with a "bellows" type arrangement for air guides, and a spring arrangement in roller systems to maintain proximity to the rail. The nature of slip form or "cast-in-place" systems also provides very smooth and jointless surfaces top to bottom, as do today's high compressive strength concrete, formwork, and agitation systems. This can be a benefit in initial construction by reducing smoothing procedures necessary and also will increase longevity of the elevator components; clearly rough surfaces accelerate wear of components in contact therewith. It should also be noted, however, that imperfections can be smoothed or patched using portable tools and materials albeit with some minor additional labor. Similar techniques can also be used in smoothing joints in pre-cast hoistway sections used in lower-rise buildings, for example.

In connection with the pouring of concrete guide rails it is also important to note that many different shapes for the rails are possible such as the rectangular shape of FIG. 1A; the "T" shape of FIG. 2 and the other shapes depicted in FIGS. 3, 4 and 5. For clarity in the drawings and although the outer rails and center rails perform the same function, the outer rails are labeled 12 and the center rails are labeled 16. Virtually any cross sectional shape may be adopted for various engineering or construction reasons such as to equalize air forces to "center" and guide the car, and to provide additional structured stability for the hoistway itself. It will be noted that each of the illustrated alternate shapes of the concrete rails of the invention provide different surfaces upon which guides will operate and that modification of the precise operation of the guides is necessary to use the alternate shapes illustrated. The illustrated guides are directed to rectangular and "T" shapes with perpendicular and parallel guide surfaces.

Figure 1B:
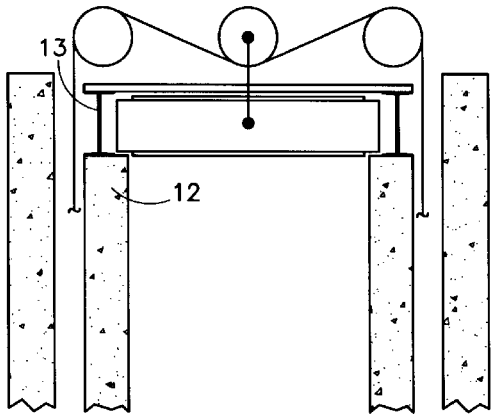
FIG. 1B is a schematic side view shown by the rails ending short of the top of the hoistway to provide a machine frame footing.

In one embodiment of the invention, as illustrated in FIG. 1B rails 12 are shorter than hoistway 10 to provide footings or tie-down supports for a machine bed plate or frame 13, which also works to support the center rail column in multiple hoistways in a side-to-side lateral direction. Alternately, the concrete rail may be poured on top of a machine and bed plate assembly mounted at the bottom of the hoistway or "pit", for a machine below arrangement as is commonly known in the art.

Lateral support for car rail columns between elevators in multiple hoistways may be best provided by conventional steel "divider beams" or similar members at each floor level, and installing these off a trailing work deck that is fastened below the slip form rig in the case of "cast-in-place" construction. Alternately, horizontal divider beams may be poured with the vertical rail column using an auxiliary slip-form system.

In lieu of conventional rollers or advanced electo-magnetic guides requiring steel or other metal rails, the elevator system of the invention is guided in the side-to-side and front-to-back planes with an air cushion system similar to an Otis air cushion system used in airport automated people mover (APM) systems for horizontal transportation. Such an air cushion system requires very little power and therefore is highly desirable for use in the invention. For comparison, a 100 person APM vehicle requires only 12 kW of blower motors to float the entire loaded vehicle, with each air pad requiring just 10 cfm of air. Since elevators are typically suspended and statically balanced on wire ropes, or alternately lifted by hydraulic rams, it is not necessary to lift or "float" the elevator car but merely to bias it to the preferred location within the hoistway. Because the load of the car in the lateral directions is small, the pressure on the guides is very small. This reduces the power requirement to desirable levels. For example, for a 2250+2250=4500 kg capacity high speed double deck elevator, which is currently considered the largest duty passenger elevator manufactured, only 1.5 kW total might be required in order to maintain the desired elevator car position in the hoistway. Typical lateral guidance forces of 1,000 to 2,000 N of force for such elevators would require an active air cushion area of approximately 968 square cm at an air pressure of about 3 psi. The air cushion size might be approximately 15 cm by 65 cm which fits conveniently along the side of the car at the top and bottom. For further comparison, more typical elevator sizes would involve a guidance force of only about 56 kilograms. Utilizing FIG. 2 and outer rails 12 to provide an understanding of the location of the pads preferred for this embodiment, a pad will be located at each of surfaces 20, 22 and 24 and it should also be noted that cushions will be located on surfaces 26, 28 and 30 of rails 16.

Figure 6:
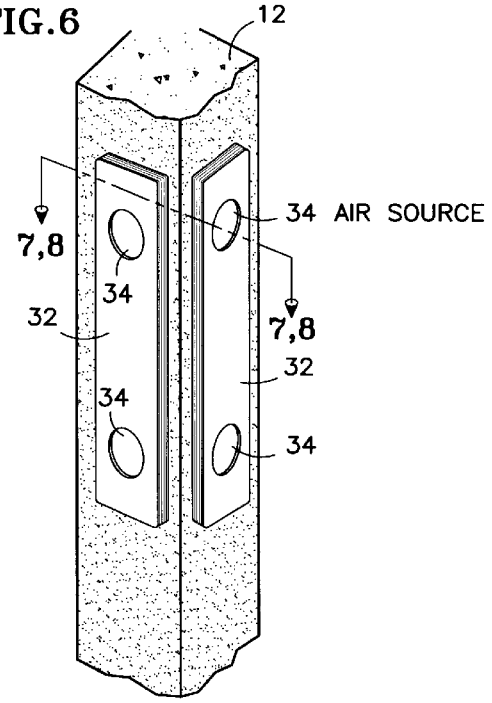
FIG. 6 is a schematic representation of an air cushion intended to act on the front surface and one side surface of the concrete rail adjacent thereto.
Figure 7:
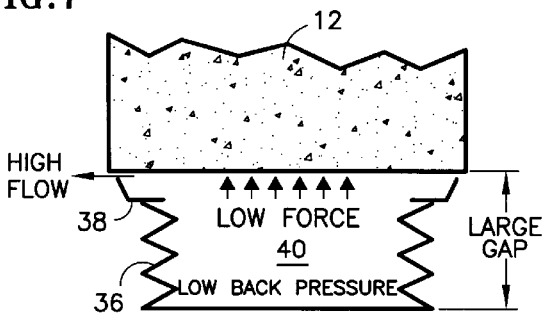
FIG. 7 is a cross section view of one air cushion from FIG. 6 in a first position.
Figure 8:
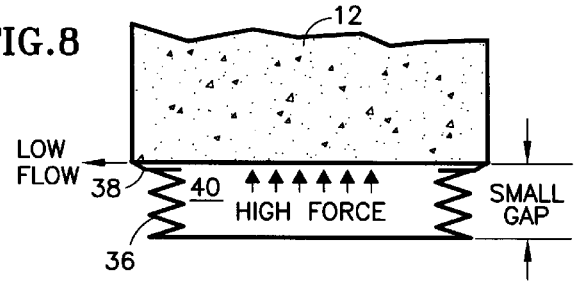
FIG. 8 is a cross section view of one air pad assembly from FIG. 6 in a second position.

A schematic positioning of two of such air cushion assemblies 32 is illustrated on a portion of a rail 12 in FIG. 6 Each cushion is connected to a blower or pressurized fluid (air) source (not shown) at least one orifice 34 and preferably two orifices 34. The cushions each include an expandable sheath or "bellows" 36 (shown in FIGS. 7 and 8) and a seal member 38. The sheath 36 is preferably energized to remain extended when not in contact with the column and compressed by an elevator car. By limiting axial length of the sheath 36, seal 38 is directly affected and helps to dictate the amount of fluid pressure contained within the space 40 defined by the sheath 36 and rail 12. More particularly, when a load is placed upon the air cushion 32, by the swaying of an elevator car (not shown) or imbalance due to where people are standing in the car, the cushion 32 is urged closer to rail 12. This motion causes-seal 38 to contact rail 12 and relatively prevent leakage of the fluid being delivered to space 40. Conversely when no load is placed upon air cushion 32, seal 38 moves out of contact with rail 12 and allows a higher fluid leakage rate. The lower and higher leakage rates stated equate to higher and lower pressure within space 40, respectively. Sheath 36 is also collapsible, one embodiment employing an accordion shape as illustrated, to gently increase the pressure within space 40 to a high enough pressure to arrest the movement of the elevator car in that direction. Upon movement in another direction, another of the plurality of air cushions will react as described. The "bellows" also acts to compensate for possible variations in the size of the rail, top vs. bottom, due to compression of the walls if no other means is taken to compensate for this effect of compression. In total, the air cushion effectively and gently maintains the elevator car centered in its shaft 18.

The effect of air cushions on both sides of the elevator, arranged for front-to-back and side-to-side movements, is an equalizing or centering effect providing a very high level of ride quality. Gate valves are provided to keep pressures below a predetermined maximum to maintain ride quality in terms of vibration. And by providing very little friction, the air guidance systems generate very little noise and reduce elevator energy consumption. The air cushions will naturally provide a degree of positional self regulation in that as any air cushion is pushed against the guide surface, the back pressure between the air cushion and the concrete guide will tend to increase, resulting in a greater force being generated to move the air cushions away from the guide. Conversely, as any air cushion moves away from the guide surface, the force generated by that air cushion will decrease, allowing the opposing air cushion to move the car back towards the center of the shaft 18. In this manner, the air cushions provide an inherent self regulation of the elevator car position as the car moves in the shaft 18.

Figure 9:
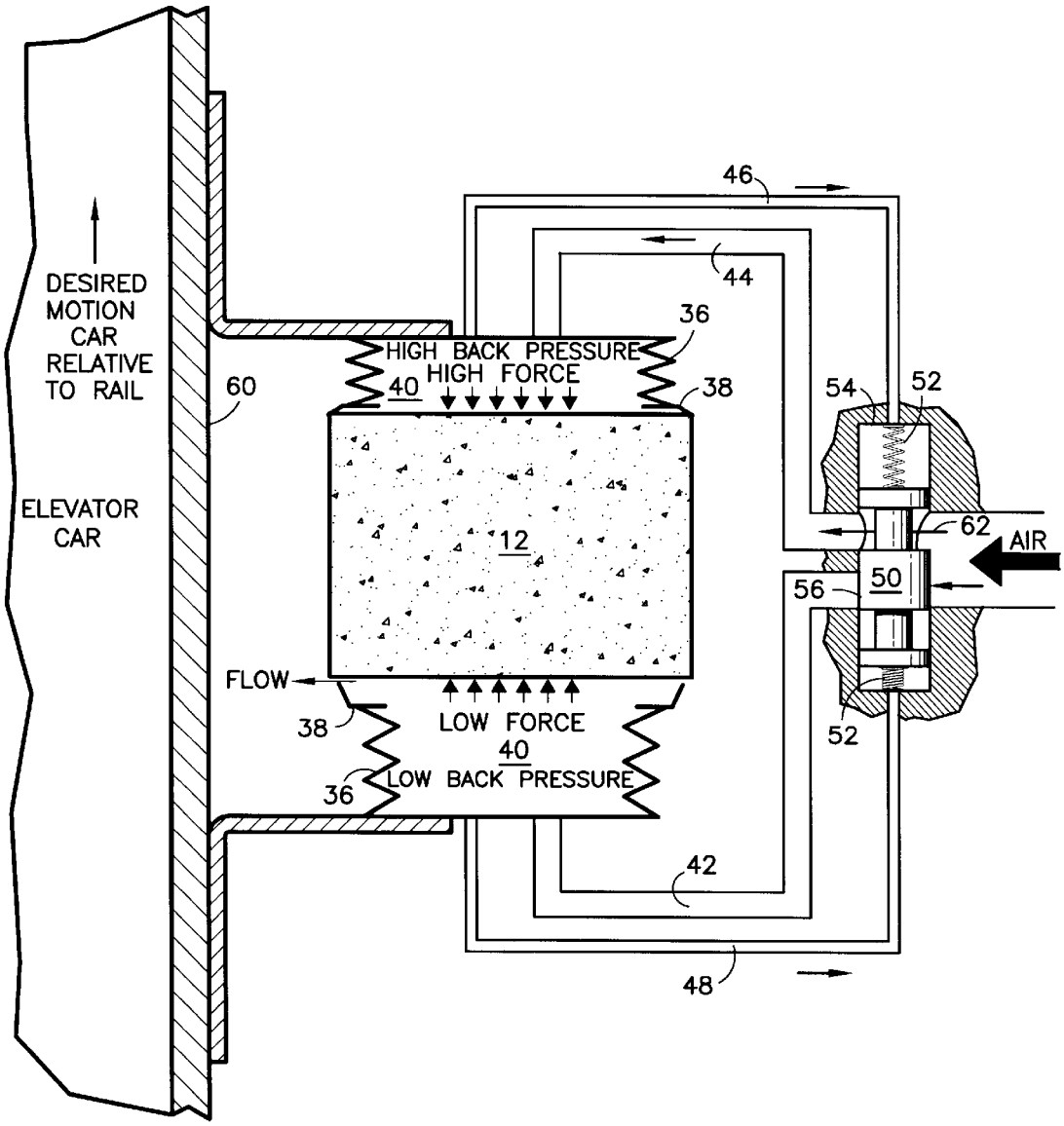
FIG. 9 is a schematic top cross section view of a spool actuated air cushion for a concrete rail guide of the invention.

To provide more self-regulation, the invention may further include a spool valve as illustrated in FIG. 9. Following exposure to the foregoing, one will recognize concrete rail 12, sheath 36 and seal 38 on each side of rail 12 as shown in FIG. 9. To supplement these portions of the invention, feed lines 42, 44 and feedback lines 46, 48 are connected to spool valve 50. Spool valve 50 is spring biased to center itself in the event pressure is static and equal in feedback lines 46 and 48. Spring biasing is accomplished preferably by springs 52. Operably, spool valve 50 comprises housing 54 and bifurcating piston 56. The piston 56 preferably includes two flow areas which may be biased to allow more or less pressurized fluid from a pressurized fluid supply (not shown) to move through valve 50 and into a selected one of feed lines 42 or 44. The piston 56 is biased toward one side or the other of valve housing 54 by one or the other of feedback lines 46 or 48. On the figure, (using the terms "upper" and "lower" and "downwardly" and "upwardly" only for the relative positions of items in the drawing and not to suggest any position in the device of the invention) the upper portion of piston 56 is being urged downwardly due to pressure supplied by feedback line 46. This pressure originates in space 40 of the upper air cushion since car frame 60 is urging seal 38 into contact with rail 12 in the upper portion of the figure. The action this causes in valve 50 of piston 56 moving downwardly allows high pressure fluid to move through valve 50 into line 44 as illustrated by arrow 62. The effect of this fluid pathway is to further increase fluid pressure in space 40 in the upper portion of the figure and tend to urge the car frame 60 toward the top of the drawing and a more centralized position in the hoistway. Pressurized fluid does not flow into line 42 because it is blocked by piston 56. Since additional fluid does not pass into space 40 in the lower portion of the drawing, a low pressure condition exists there and is conducive to car frame 60 moving in that direction toward the top of the drawing. It should be that in a preferred embodiment of the invention one spool valve operates each pair of front to back air cushions and an additional spool valve operates a pair of side to side cushions.

Figure 10:
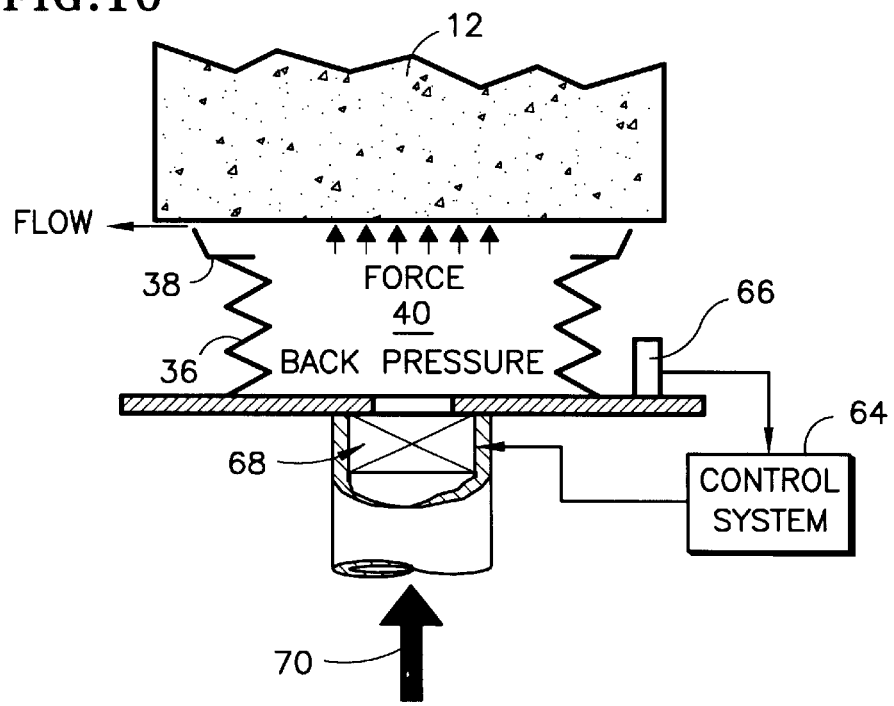
FIG. 10 is a schematic top cross section view of a variable orifice valve system of the invention.

In another embodiment of the invention, referring to FIG. 10, regulation of pressure is accomplished by a control system 64 interconnected with a gap sensor 66 which may be any one of a number of conventional sensors capable of measuring the distance between the sensor and rail 12 such as a laser device, an acoustic device, etc. Control system 64 is further connected to a pressure regulator such as a variable orifice valve 68 interposed between a fluid pressure source 70 and space 40. Control system 64 is programmed to read information from gap sensor 66 and control the size of the orifice in orifice valve 68 to regulate the amount of pressurized fluid being supplied to space 40. Orifice valve 68 will be reduced in size when the rail 12 is farther from gap sensor 66 and increased in size when the rail 12 is closer to gap sensor 66. Preferably control system 64 is connected to all of the air cushions used in the system so that balanced pressures can be maintained to most efficiently center the elevator car in a shaft of the hoistway.

Figure 11:
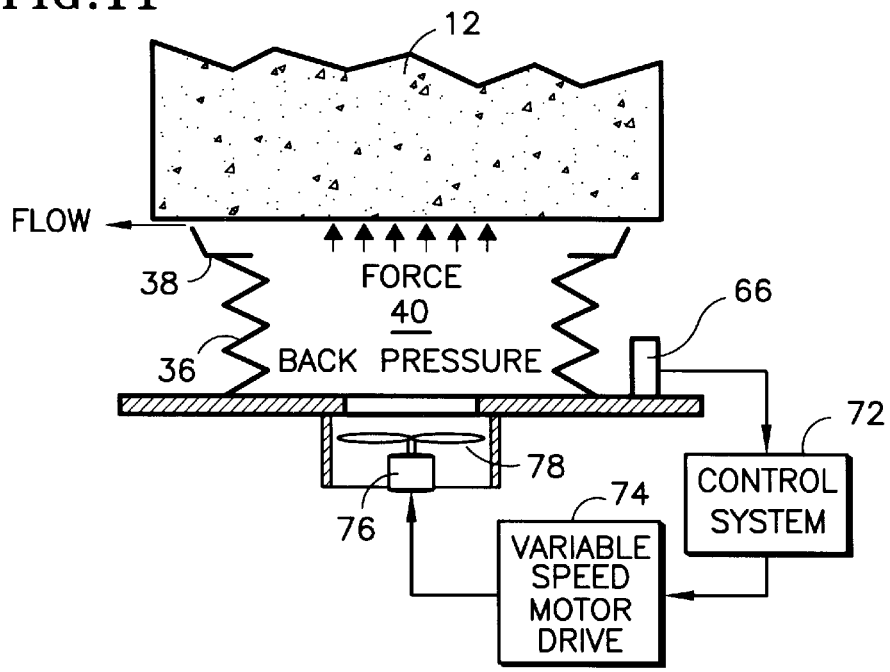
FIG. 11 is a schematic top cross section view of a variable speed fan system of the invention.

In yet another embodiment of the invention, referring to FIG. 11, a control system 72 is similar to control system 64 in that it receives information from a gap sensor 66 and responds thereto but differs in that its programming is for operable connection to and control of a variable speed motor drive 74 which drives a motor 76 connected to a blower fan 78. The blower fan 78 creates the pressurized fluid supply in space 40 and can be regulated simply by motor speed. This embodiment does not require a remote pressurized fluid source and the connective conduits and may be preferable to other systems in applications where access to such remote pressurized fluid sources is difficult.

Figure 12:
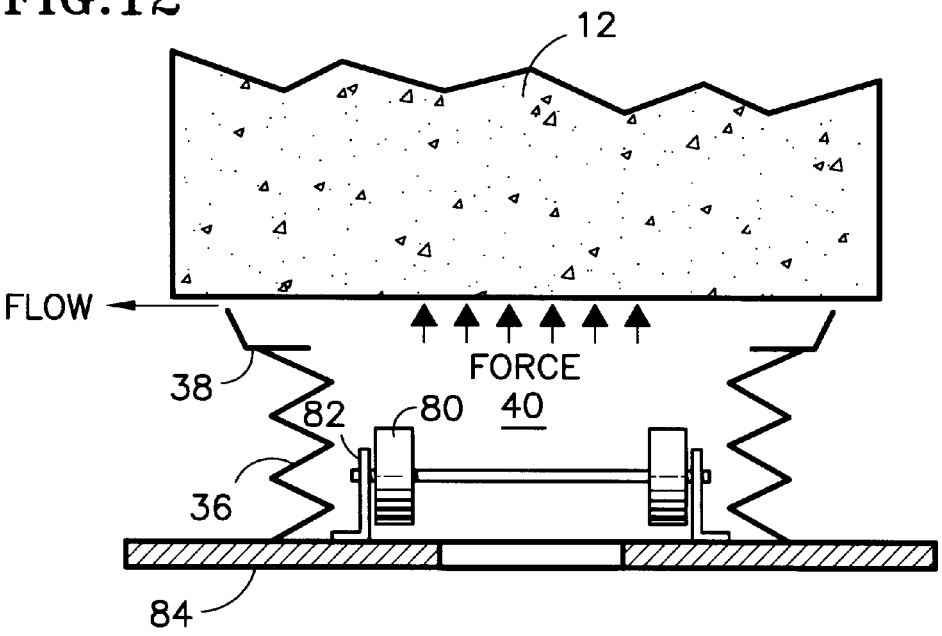
FIG. 12 is a schematic cross section view illustrating the back-up roller wheels for the air guide system of the invention.
Figure 13:
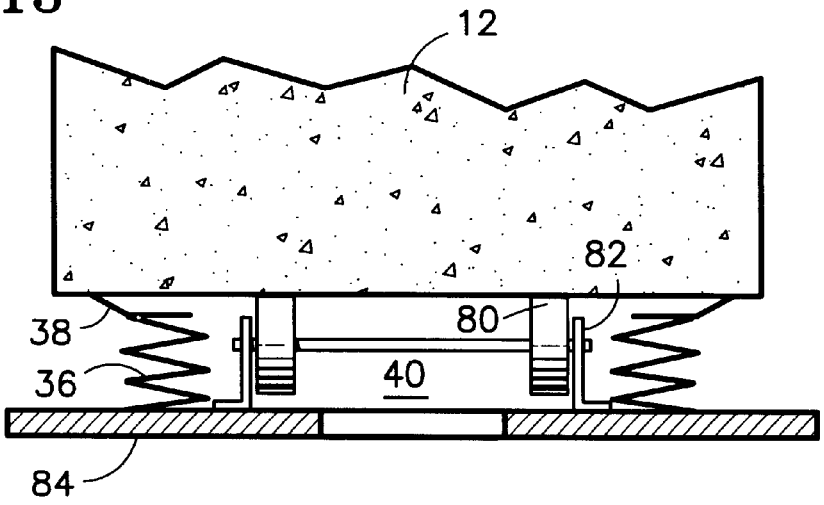
FIG. 13 is the view of FIG. 12 in an alternate position.

In another aspect of the invention which may be optionally included, referring to FIGS. 12 and 13, are rollers acting in concert with and as a backup for the lateral thrust of the car air cushions 32. Backup rollers also serve to provide limits to lateral car travel under severe conditions (also to prevent the car from interfering with other hoistway mounted apparatus). In these figures, the rollers 80 are fixedly attached by a bracket 82 to a backing plate 84 which is attached to an elevator car (not shown). Viewing the figures sequentially provides an understanding of the action of the rollers 80 in controlling the elevator car. In FIG. 12, the car has moved away from the illustrated side of rail 12 and the rollers 80 are not in contact therewith. In FIG. 13, conversely, the car has moved toward the rail 12 and the rollers 80 are in contact with rail 12. In this position the rollers 80 help stabilize the elevator car. In the event the car moves more than expected in one direction, due to uneven loading or for other reasons, the rollers will prevent the car from contacting rail 12 which would reduce the service life of the air cushions 32 and other components of the elevator system.

It will also be understood that brackets 84 may be replaced by springs or selectively actuatable devices such as solenoids, etc., in order to provide additional resilience to rollers 80 or to allow a selective halt of rocking movement of the elevator car when approaching a target floor or to reduce the size of the blower or fan, or to reduce blower speed and/or halt blower operation when an elevator is at a floor or approaching the same. Solenoids, for example, extending the rollers into contact with rail 12 from all surfaces simultaneously as the car nears a stop at the target floor will prevent all rocking movement of the elevator car and may therefore be desirable. Such solenoids may preferably be operated by a controller to ensure simultaneous operation. The same system could also be employed to keep an elevator car in service in the event the air cushion system failed. By using solenoids to draw spring loaded rollers away from the rails, a loss of power to the solenoids will allow the rollers to move into contact with the rails. The loss of power may be programmed into the system directly or initiated by a controller or simply be an actual loss of power. The rollers may be constructed of polyurethane or similar solid material, or may be air-inflated pneumatic tires for smoother operation.

Such tire or roller guides may be used in a conventional manner, although in the invention they would ride on the concrete rails, with no air guides, for low or medium speed elevators where the rollers or tires will not contribute significant noise.

While preferred embodiments have been shown and described, various modifications and substitutions may be made thereto without departing from the spirit and scope of the invention. Accordingly, it is to be understood that the present invention has been described by way of illustrations and not limitation.

Figure 14:
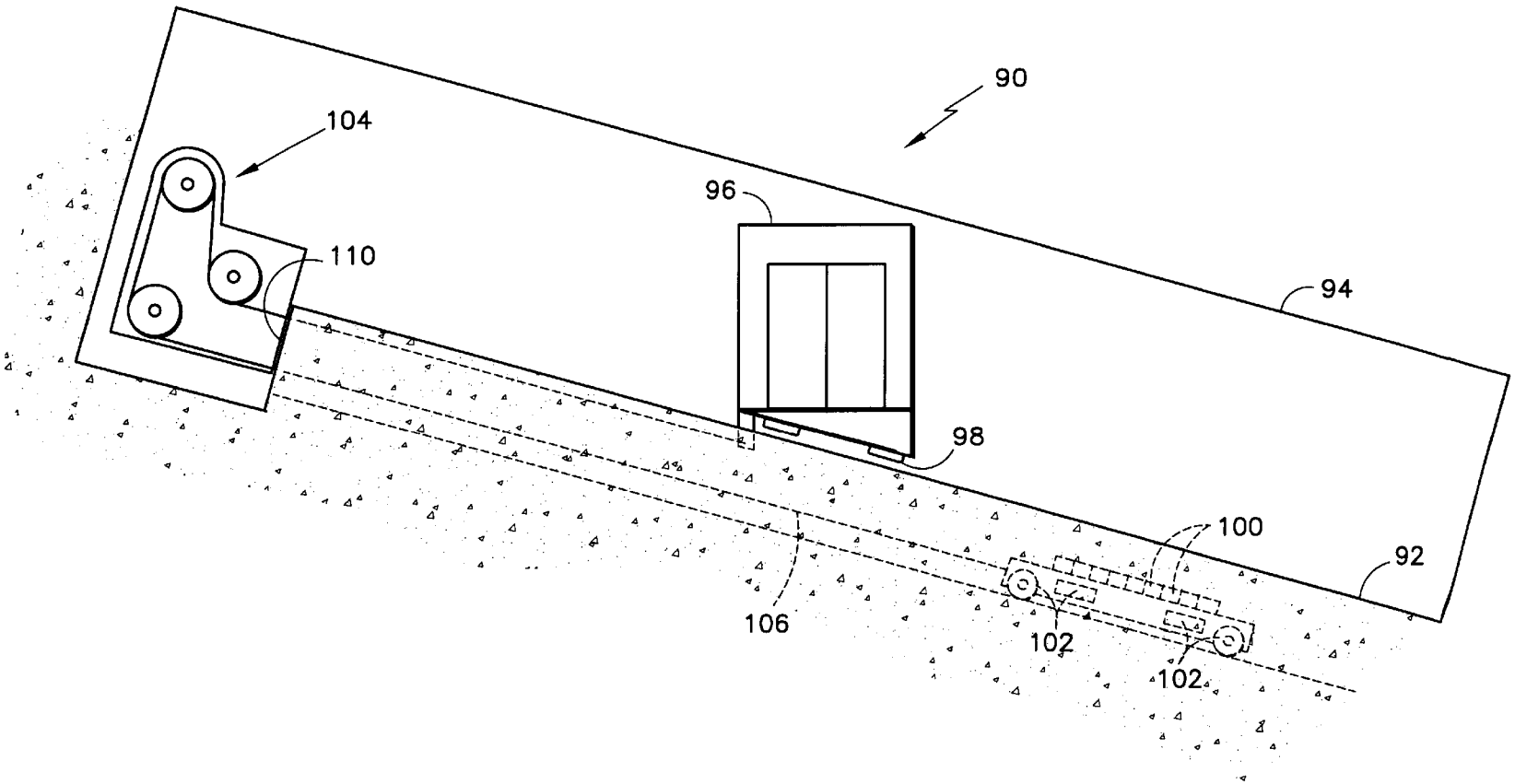
FIG. 14 is an elevation view of an alternative embodiment of the invention employed in connection with an inclined elevator or people mover.

Another embodiment of the invention is illustrated in FIG. 14. An inclined elevator or people mover system 90 is supported upon a concrete rail system 92 which preferably is constructed integrally with the hoistway 94. Elevator car 96 is a conventional type of car used in conjunction with inclined elevators or people movers but preferably is modified at its guides to be either a roller/tire arrangement (not shown) for low speed applications or air cushions 98 for higher speed applications. In lower speed applications, a roller or tire guide system is sufficient to provide excellent ride quality while the air cushion system would be preferred for higher speed applications because passengers in the elevator car 96 would be able to feel bumps through rollers or tires at higher speeds. The air cushions 98 preferably are as in the embodiments described hereinbefore. One will notice that in the illustration, counterweight 100 is provided with tire guides 102 as opposed to air guides. The air guides may of course be substituted here but are more expensive and since most inclined elevator systems move slowly, tire guides 102 should be sufficient for the counterweight 100 even if air guides 98 are preferred on car 96.

In other respects the inclined elevator system 90 is as it would be in the prior art including machine and sheave assembly 104 and rope 106. Preferably and in accordance with an important aspect of the invention discussed relative to the foregoing embodiments, the concrete rail 92 is ended short of the top of the hoistway 94 to allow the concrete rail to also provide a footing or tie down point 110 to support and anchor the machine and sheave assembly 104.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An elevator system comprising:

a wall structure defining an elongated hoistway;

a plurality of guide rails disposed on said wall structure;

an elevator car disposed within said hoistway and movable longitudinally therewithin;

a first air cushion, disposed on said elevator car intermediate the car and one guide surface of one of said plurality of guide rails, for positioning said car laterally with respect to said one guide surface;

a second air cushion disposed on said elevator car intermediate the car and an other guide surface of said one guide rail, wherein said first air cushion is arranged opposite said one surface of said one guide rail and said second air cushion is arranged opposite said other guide surface of said one guide rail; and wherein the first and second air cushions are each fluidly connected to a common spool valve, said spool valve supplying pressurized air selectively to each of the first and second air cushions.

2. The elevator system as recited in claim 1, wherein said spool valve is automatically responsive to pressure within each of the air cushions to which it is connected, and directs pressurized air to the air cushion having a higher pressure.

3. The elevator system as recited in claim 1, wherein said system further includes a proximity sensor;

a controller in communication with said proximity sensor; and a pressure regulator disclose to said controller directing said regulator in response to signals provided by said proximity sensor.

4. The elevator system as recited in claim 3, wherein said pressure regulator is a valve connected to a pressurized air source.

5. The elevator system as recited in claim 4, wherein said valve is a variable orifice valve.

6. The elevator system as recited in claim 3, wherein said pressure regulator is a fan.

* * * * *